US008899388B2

(12) United States Patent
De la Fuente Farias

(10) Patent No.: US 8,899,388 B2
(45) Date of Patent: Dec. 2, 2014

(54) BRAKE BEAM ASSEMBLY

(75) Inventor: Jorge Alberto De la Fuente Farias, Monterrey (MX)

(73) Assignee: A. Stucki Company, Moon Township, PA (US)

( * ) Notice: Subject to any disclaimer, the term of this patent is extended or adjusted under 35 U.S.C. 154(b) by 300 days.

(21) Appl. No.: 12/763,356

(22) Filed: Apr. 20, 2010

(65) Prior Publication Data

US 2011/0253492 A1 Oct. 20, 2011

(51) Int. Cl.
*B61H 13/36* (2006.01)

(52) U.S. Cl.
CPC ..... *B61H 13/36* (2013.01)
USPC ..... 188/219.1; 188/233.3

(58) Field of Classification Search
CPC ..... B61H 13/36
USPC ..... 188/219.1, 222.1, 223.1, 225.6, 228.6, 188/233.3, 233.7
See application file for complete search history.

(56) References Cited

U.S. PATENT DOCUMENTS

| | | | |
|---|---|---|---|
| 2,170,121 | A | 8/1939 | Busch |
| 2,193,580 | A | 3/1940 | Busch |
| 2,427,548 | A | 9/1947 | Busch |
| 2,499,905 | A | 3/1950 | Cottrell |
| 2,702,614 | A | 2/1955 | Spaeth |
| 2,722,291 | A | 11/1955 | Welp |
| 2,753,960 | A | 7/1956 | Stevens |
| 3,998,299 | A | 12/1976 | Fuller |
| 4,830,148 | A | 5/1989 | Hart et al. |
| 5,810,124 | A | 9/1998 | Sandmann |
| 6,138,800 | A | 10/2000 | Deramaux et al. |
| 6,155,387 | A | 12/2000 | Sauter |
| 6,155,388 | A | 12/2000 | Sandmann |
| 6,155,389 | A | 12/2000 | Sandmann |
| 6,193,028 | B1 | 2/2001 | Elizalde-Siller et al. |
| 6,234,283 | B1 | 5/2001 | Montes-Ramos |
| 6,332,515 | B1 | 12/2001 | Sauter |
| 6,551,003 | B1 | 4/2003 | De La Fuente-Farias |
| 6,739,438 | B1 | 5/2004 | Leon-Rovira et al. |
| 6,932,535 | B2 | 8/2005 | De La Fuente-Farias |
| 7,410,037 | B2 | 8/2008 | De La Fuente-Farias |
| 2006/0219502 | A1 | 10/2006 | De La Fuente-Farias |

OTHER PUBLICATIONS

PCT International Search Report, dated Jul. 21, 2010 (3 pages).
PCT Written Opinion, dated Jul. 21, 2010 (10 pages).

*Primary Examiner* — Bradley King
*Assistant Examiner* — Nicholas J Lane
(74) *Attorney, Agent, or Firm* — Buchanan Ingersoll & Rooney PC

(57) ABSTRACT

A low weight and low cost brake beam assembly having high static strength and fatigue resistance having two independent brake heads each including a receiving section for receiving and retaining an end of a tension member, an end of a compression member and a portion of an end extension.

25 Claims, 14 Drawing Sheets

BRAKE BEAM ASSEMBLY

FIELD OF THE INVENTION

The present invention is directed toward brake beams for railway cars and, more particularly, toward a low weight and low cost brake beam assembly having high static strength, fatigue resistance, replacement ability of wear components.

BACKGROUND OF THE INVENTION

There are well known brake heads assemblies for railway cars by which a brake shoe is pressed against a wheel in order to decrease or stop the rotational speed of the wheel and of the railway car for braking. The brake heads are typically actuated by a pneumatic actuation system.

Generally, a structure called a "brake beam" is mounted transversely in the bogie of a railway car and is linked to a lever, which applies a force in order to press a brake shoe of a brake head against a wheel to apply a braking force to the wheel. Often, the brake beam has two ends and each end is attached to a respective break head. Examples of brake beam assemblies may be appreciated from U.S. Pat. Nos. 2,170,121, 2,193,580, 2,427,548, 2,499,905, 2,702,614, 2,722,291, 2,753,960, 3,998,299, 4,830,148, 6,138,800, 6,155,387, 6,234,283, and 6,332,515, and U.S. Publication No. 2006/0219502.

There are many brake beams in the market which claim to be resistant to mechanical stress without adding weight to the brake beam, such as that disclosed in the U.S. Pat. Nos. 5,810,124, 6,155,388, and 6,155,389. For example, U.S. Pat. Nos. 5,810,124, 6,155,388, and 6,155,389 each disclose a brake beam assembly made up of a compression member, a tension member, a strut connected to the tension member and to the compression member, and two brake heads with recesses. The ends of the compression member and of the tension member are disposed within the recesses of the brake heads together with at least two fasteners per recess. Each of the fasteners are substantially perpendicular to the tension member and to the compression member. No other structural elements are present in the recesses of the brake heads.

Although it is mentioned that the above referenced brake beam designs provide adequate high static strength and fatigue resistance, the end extension and brake head are formed as a single piece, which may be problematic when the brake head has to be replaced. For instance, such a brake head design requires the tension member and compression member portions of the brake beam to be cut, or otherwise disassembled, in order to remove a damaged brake head from the brake beam. Furthermore, since all of the pressure from the breaking action and the forces derived from maintaining the brake beam in place are concentrated in the brake head component, which has an integral extension component, the brake heads are prone to experience significant fatigue, which may damage the brake head or other components of the brake beam assembly. Such fatigue may also cause the brake head to fail.

A new brake beam assembly is needed that provides a design permitting the brake heads to be easily replaced without requiring other components of the brake beam assembly to be cut, removed, or disassembled from a railway car to which it is mounted. Preferably, such a brake beam assembly would provide a design that increases the service life of brake head components and would provide improved high static strength and fatigue resistance. Such a design would also preferably have a relatively low weight and a relatively low cost for manufacture.

A typical brake beam suffers the wear of the brake heads as the must common condition for brake beam replacement. Under the present design, the concept of a replaceable brake head is followed, by having the end extension as a separate element from the brake head, where the brake head can be removed from the beam with a minimum effort while the beam is still mounted on the freight car truck. A new brake head can be applied to the same brake beam end by simple and normally available tools to the maintenance railroad crews, thus reducing significantly the maintenance cost and time to the car owner and the railroad, by being able to reutilize the non-damaged majority of the brake beam without disassembling the freight car, and without the present need to remove the freight car from the train to later be displaced toward a specialized car shop for its brake beam replacement.

The present invention is directed toward overcoming one or more of the above-mentioned problems.

SUMMARY OF THE INVENTION

In view of the above referred problems, a new brake beam assembly which has a replaceable availability without harming or effecting another components thereof, high static strength and fatigue resistance while maintaining a low weight and a low cost is described herein.

Embodiments of the inventive brake beam assembly may include a flat, generally V-shaped tension member, a compression member having an L-shaped cross-section, a strut attached between the tension member and the compression member, and two brake heads, each having a retaining member that includes a cavity for tightly receiving and retaining a respective end of the tension member and a respective end of a compression member, as well a portion of an end extension. The brake beam assembly also includes a pair of end extensions. Each end extension is attached to a respective brake head such that a portion of that end extension is retained within the cavity of the brake head. In preferred forms, the compression member is nearly straight or slightly bent.

Since the brake heads are separate structural components that are independent from the end extensions to which they are attached, it is possible to replace them without harming or affecting other components of the brake beam assembly, such as the tension member and/or the compression member. Further, the brake beam assembly does not need to be removed from a railway car to which it is attached or otherwise disassembled to remove and replace a brake head. Such functionality can permit brake heads to replaced more quickly and reduce the costs associated with such replacements.

Furthermore, since the end extensions and brake heads are separate structures, the braking forces are distributed between the extensions and brake heads which may avoid an excess of stress experienced by a single piece component. Since the braking force and the stress and strain applied by the application of such a force on the brake beam assembly may be distributed to an end extension, the brake head may experience a lower amount of stress and strain and therefore experience less wear. Further, the brake heads may experience less fatigue such that the brake heads have a longer service life or are less likely to be damaged than the brake heads disclosed in the prior art, such as the brake heads disclosed in U.S. Pat. Nos. 5,810,124, 6,155,388, and 6,155,389.

Some embodiments of the brake beam assembly may include a generally flat, V-shaped tension member, a compression member having an L-shaped cross-section, a strut member, a first end extension, a second end extension, a first brake head and a second brake head. The tension member may have an apex portion located between first and second end portions. The first and second end portions each have first and second apertures formed therein. The compression member has a central portion between first and second end portions. The compression member may be nearly straight or slightly bent. The first and second end portions of the compression member have first and second apertures formed therein. The strut member is positioned between the tension member and the compression member. The strut member has a first end portion attached to the apex portion of the tension member and a second end portion attached to the central portion of the compression member. The strut member may be reversible, non-reversible, or semi-reversible.

The first end extension has a pocket guide coupling portion and a brake head coupling portion. The brake head coupling portion has a first opening and a second opening. The pocket guide coupling portion is sized and configured for attachment to a portion of a railway car.

The second end extension has a pocket guide coupling portion and a brake head coupling portion. The brake head coupling portion has a first opening and a second opening. The pocket guide coupling portion is sized and configured for attachment to a portion of a railway car;

The first brake head has a cavity sized and configured to receive the first end portion of the tension member, the first end portion of the compression member and the brake head coupling portion of the first end extension. The cavity is in communication with a first hole and a second hole formed in the first brake head. The first end portion of the compression member, the first end portion of the tension member and the brake head coupling portion of the first end extension are positioned within the cavity of the first brake head such that the first aperture of the first end portion of the tension member, the first aperture of the first end portion of the compression member, the first opening of the brake head coupling portion of the first end extension and the first and second holes of the first brake head are aligned to receive a first fastener attaching the first end portion of the compression member, the first end portion of the tension member and the brake head coupling portion of the first end extension to the first brake head.

The second brake head has a cavity sized and configured to receive the second end portion of the tension member, the second end portion of the compression member and the brake head coupling portion of the second end extension. The cavity is in communication with a first hole and a second hole formed in the second brake head, the second end portion of the compression member, the second end portion of the tension member and the brake head coupling portion of the second end extension are positioned within the cavity of the second brake head such that the first aperture of the second end portion of the tension member, the first aperture of the second end portion of the compression member, the first opening of the brake head coupling portion of the second end extension and the first and second holes of the second brake head are aligned to receive a second fastener attaching the second end portion of the compression member, the second end portion of the tension member and the brake head coupling portion of the second end extension to the second brake head.

The first end extension, the first end portion of the tension member and the first end portion of the compression member are also aligned such that the second opening of the brake head coupling portion of the first end extension, the second aperture of the first end portion of the tension member and the second aperture of the first end portion of the compression member are aligned to receive a third fastener attaching the first end extension, the first end portion of the tension member and the first end portion of the compression member together at a position external to the first brake head cavity and positioned closer to the central portion of the compression member than the first brake head.

The second end extension, the second end portion of the tension member and the second end portion of the compression member are aligned such that the second opening of the brake head coupling portion of the second end extension, the second aperture of the second end portion of the tension member and the second aperture of the second end portion of the compression member are aligned to receive a fourth fastener attaching the second end extension, the second end portion of the tension member and the second end portion of the compression member together at a position external to the second brake head cavity and positioned closer to the central portion of the compression member than the second brake head.

The first end extension and first brake head are independent structures and the second end extension and the second brake head are independent structures.

In some embodiments, the first, second, third, and fourth fasteners may be bolts or other fasteners.

In one embodiment of the brake beam assembly, the compression member may include a first plate attached to a second plate along respective edges such that the first plate defines a surface that is positioned approximately 90-degrees relative to a surface defined by the second plate to provide the L-shaped cross-section.

Preferably, the first fastener is the only fastener positioned within the cavity of the first brake head and the second fastener is the only fastener positioned in the cavity of the second brake head. The strut may be a reversible fulcrum or a non-reversible fulcrum. The generally V-shaped tension member, the compression member, the first end extension and the second end extension may each be composed of steel or other metal.

In some embodiments, the cavity of the first brake head may be at least partially defined by a first generally U-shaped retaining member and the cavity of the second brake head may be at least partially defined by a second generally U-shaped retaining member.

Other embodiment of the brake beam assembly may include a strut member attached between a tension member and a compression member. A generally U-shaped retaining member of a first brake head may receive the first end portion of the tension member, the first end portion of the compression member, and the first portion of a first end extension so that a first fastener extends through apertures formed in the generally U-shaped retaining member, compression member, tension member and first end extension to attach the first brake head, tension member, compression member and first end extension together. The second portion of the first end extension extends beyond the generally U-shaped retaining member and is positioned external to the generally U-shaped retaining member of the first brake head so that the second portion of the first end extension is closer to the strut than the generally U-shaped retaining member of the first brake head. A second fastener extends through apertures formed in the second portion of the first end extension, the compression member, and the tension member to attach the tension member, compression member and first end extension together at a position located external to the generally U-shaped retaining member of the first brake head.

Preferably, the brake beam assembly also includes a second end extension, a second brake head, and third and fourth fasteners. A generally U-shaped retaining member of the second brake head receives the second end portion of the tension member, the second end portion of the compression member, and the first portion of the second end extension so that the third fastener extends through apertures formed in the generally U-shaped retaining member, compression member, tension member and first end of the second end extension to attach the second brake head, tension member, compression member and second end extension together. The second portion of the second end extension extends beyond the generally U-shaped retaining member and is positioned external to the generally U-shaped retaining member of the second brake head so that the second portion of the second end extension is closer to the strut than the generally U-shaped retaining member. The fourth fastener extends through apertures formed in the second portion of the second extension, compression member and tension member to attach the tension member, compression member and second end extension together at a position located external to the generally U-shaped retaining member of the second brake head.

It is therefore a main object of the present invention to provide an embodiment of a brake beam assembly that includes a generally V-shaped tension member, a nearly straight or slightly bent compression member having an L-shaped cross-section, a strut retained between the tension member and the compression member, and two brake heads each having a generally U-shaped retaining member that defines a cavity for tightly receiving and retaining respective ends of the tension member and the compression member, as well as a portion of an end extension.

It is another object of the present invention to provide an embodiment of a brake beam assembly of the above referred nature which has high static strength and fatigue resistance while maintaining a low weight and a low cost.

It is a further object of the present invention to provide an embodiment of a brake beam assembly in which it is possible to replace the brake heads without harming, effecting or disassembling other components thereof and without disconnecting the brake beam assembly from the truck of a railway car to which the brake beam assembly is mounted.

These and other objects and advantages of embodiments of the brake beam assembly of the present invention can be obtained by persons having ordinary skill in the art, from a study of the following detailed description of the embodiments of the invention which is made with reference to the accompanying drawings, and the appended claims.

DETAILED DESCRIPTION OF THE INVENTION

Figure 1:
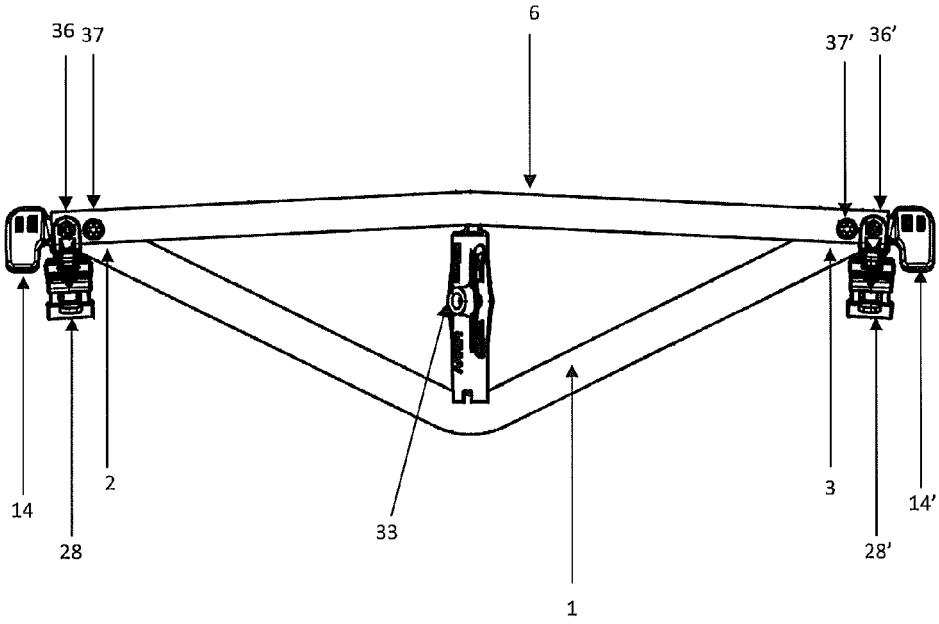
FIG. 1 is a front view of a first presently preferred embodiment of the brake beam assembly of the present invention.

Referring to FIGS. 1-14, an embodiment of the inventive brake beam assembly includes a generally flat, V-shaped tension member 1, a compression member 6 and a strut, or fulcrum, 33 positioned between the tension member 1 and compression member 6. A pair of brake heads 28, 28' are attached at opposite ends of the brake beam assembly. Each end of the compression member may be attached to a respective end of the tension member 1 within a cavity 29 of the brake head 28, 28'.

Figure 4:
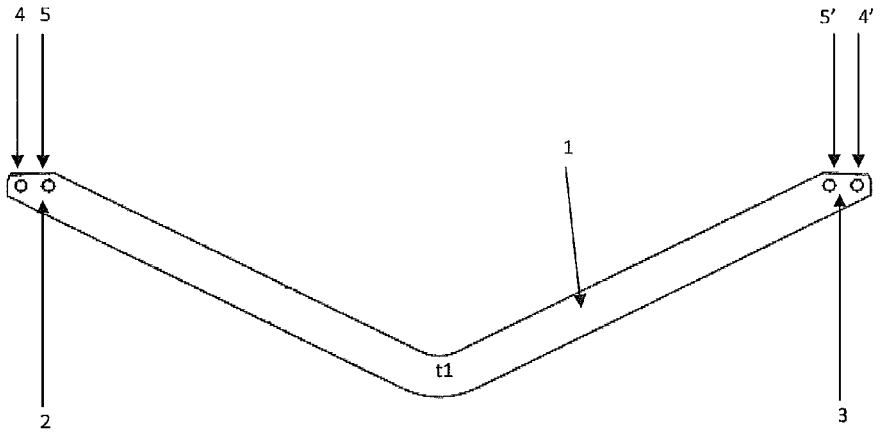
FIG. 4 is a front view of the tension member of the first presently preferred embodiment of the brake beam assembly.
Figure 5:
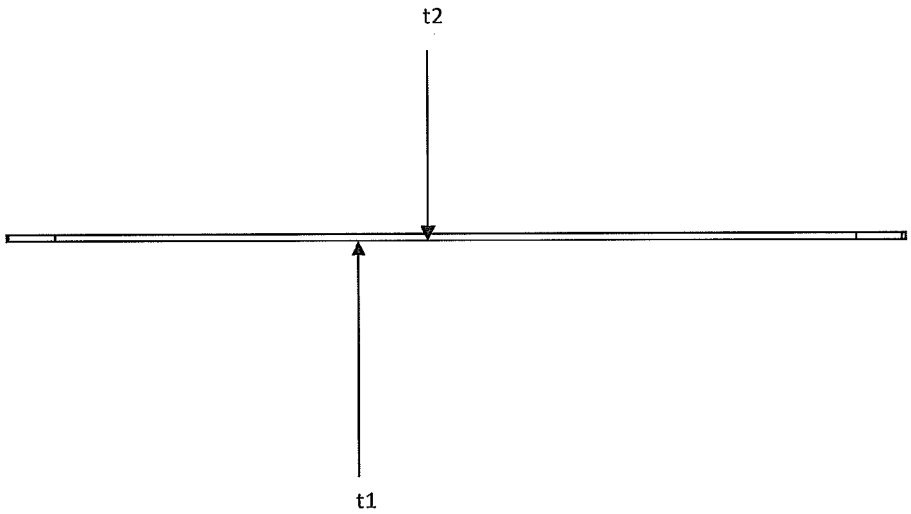
FIG. 5 is a superior view of the tension member of the first presently preferred embodiment of the brake beam assembly.

As shown more clearly in FIGS. 4-5, the generally V-shaped tension member 1 has a first end portion 2 and a second end portion 3. The first end portion 2 includes a first hole 4 and a second hole 5. The second end portion 3 includes a first hole 4' and a second hole 5'. The holes 4, 5, 4' and 5' may be formed in the tension member 1 such that the holes are contiguous with the tension member 1. The tension member 1 is preferably flat having a generally rectangular cross-section, and includes a first surface t1 and a second surface t2 opposite the first surface t1. The tension member 1 may be molded, extruded, or otherwise formed of metal. Preferably, the tension member 1 is composed of steel, but may be made of other materials having similar mechanical properties.

The tension member 1 preferably has a thickness of 0.5 inches and a width of 3.0 inches, which cross-section is the must optimum for a tension section that provides the proper force and rigidity necessary to provide the minimum deflection under load while resisting the fatigue cycle forces, at the minimum weight, and thus reduces cost and handling efforts. This reduced tension member thickness allows for the use of reduced diameter punched or drilled holes 4, 4' and 5, 5', i.e., at a diameter of 0.5 inches or greater, in as many bolts necessary for an effective holding force of its elements without causing a premature wear in the punching or drilling equipment. Preferably for this application, two bolts of 0.75 inch diameter are utilized in two 0.75 inch punched/drilled holes per beam end in order to hold the entire brake beam elements. This provides a joint rigid enough to prevent element displacement which would otherwise produce an excessive elastic deformation of the structure under high stress. This added rigidity will effectively prevent an excessive deformation of the brake rigging system that would affect the braking efforts of the freight car under emergency conditions. Such flexure may relieve load from the compression member 6, which can improve the service life of the compression member 6 and reduce the wear experienced by the compression member 6. The dimensions provided for the tension member 1 herein are for exemplary purposes only, and other dimensions may be used without departing from the spirit and scope of the present invention.

Figure 6:
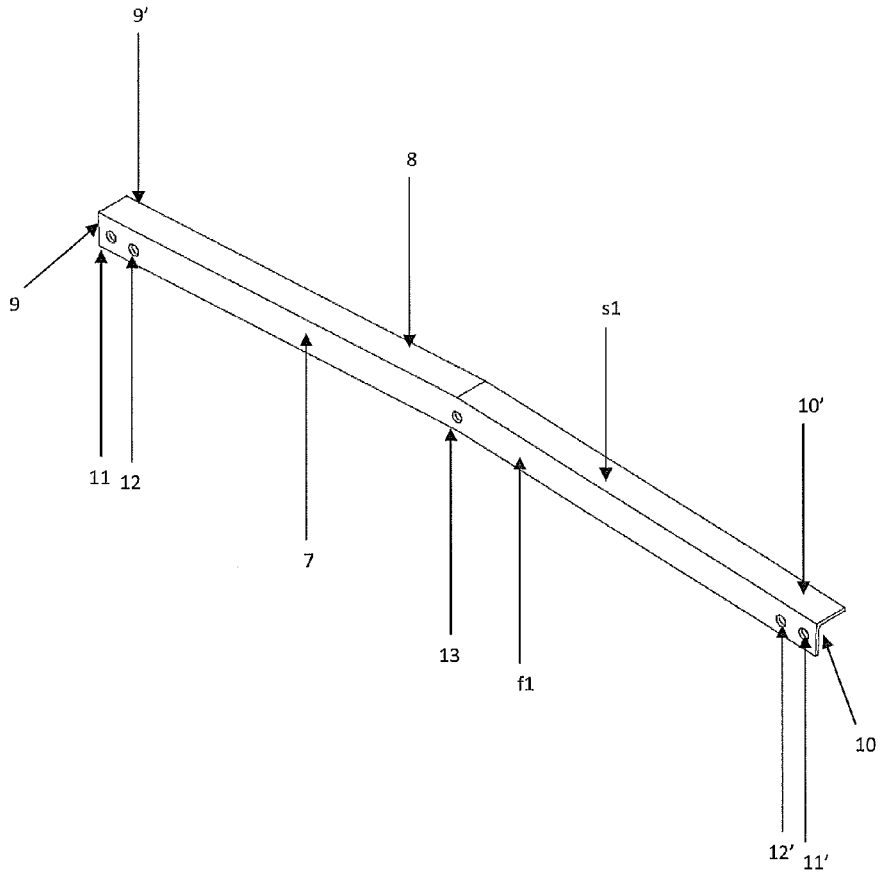
FIG. 6 is a perspective view of the compression member of the first presently preferred embodiment of the brake beam assembly.
Figure 7:
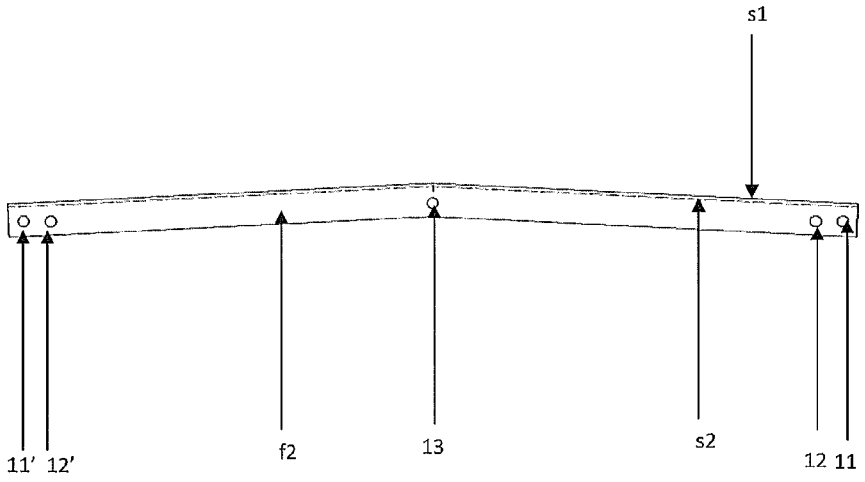
FIG. 7 is a rear view of the compression member of the first presently preferred embodiment of the brake beam assembly.
Figure 8:
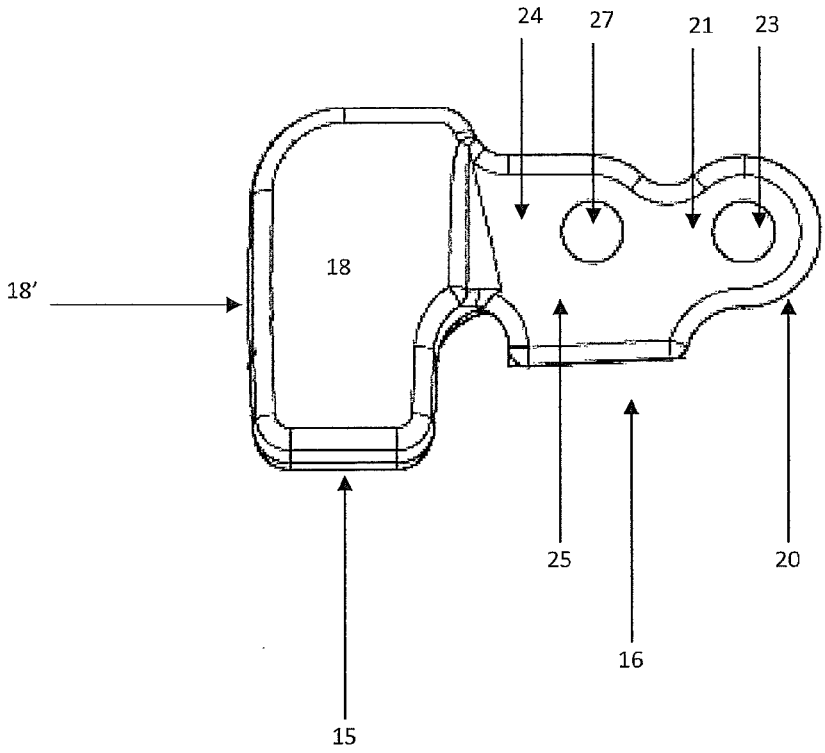
FIG. 8 is a rear view of an end extension of the first presently preferred embodiment of the brake beam assembly.
Figure 9:
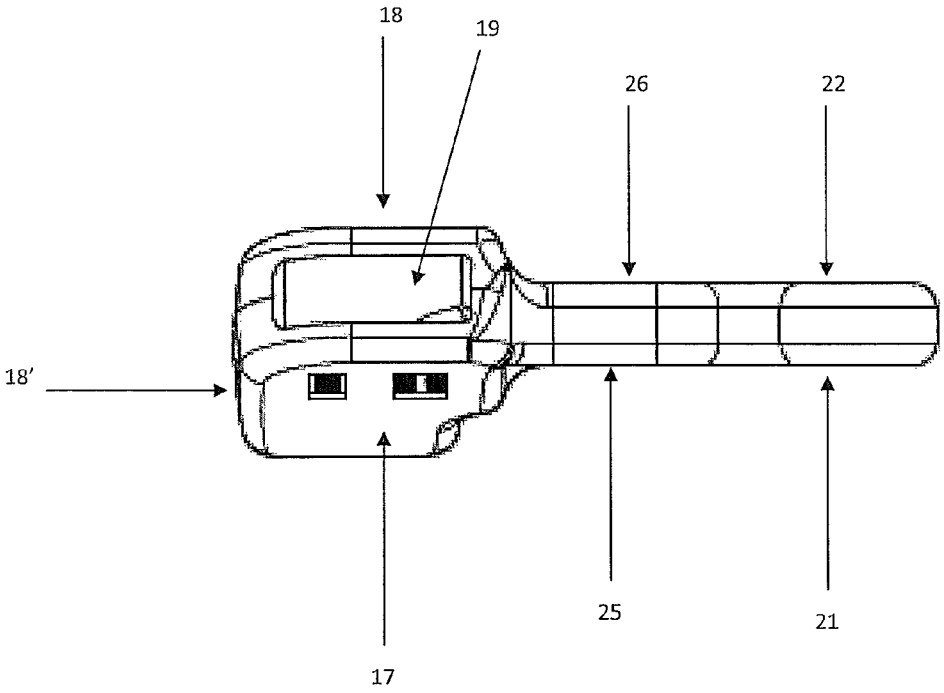
FIG. 9 is a perspective view of an end extension of the first presently preferred embodiment of the brake beam assembly.
Figure 10:
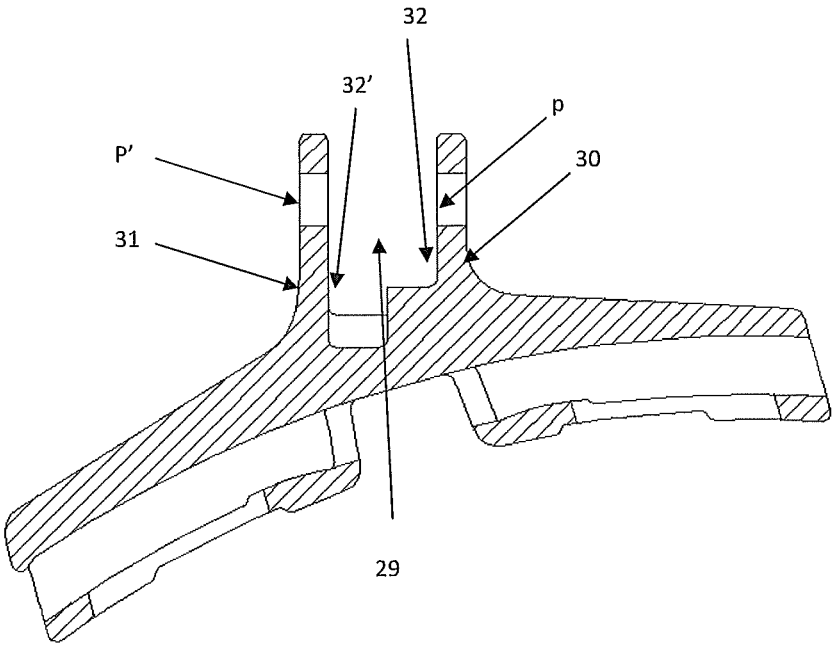
FIG. 10 is a cross sectional view of a brake head of the first presently preferred embodiment of the brake beam assembly.
Figure 11:
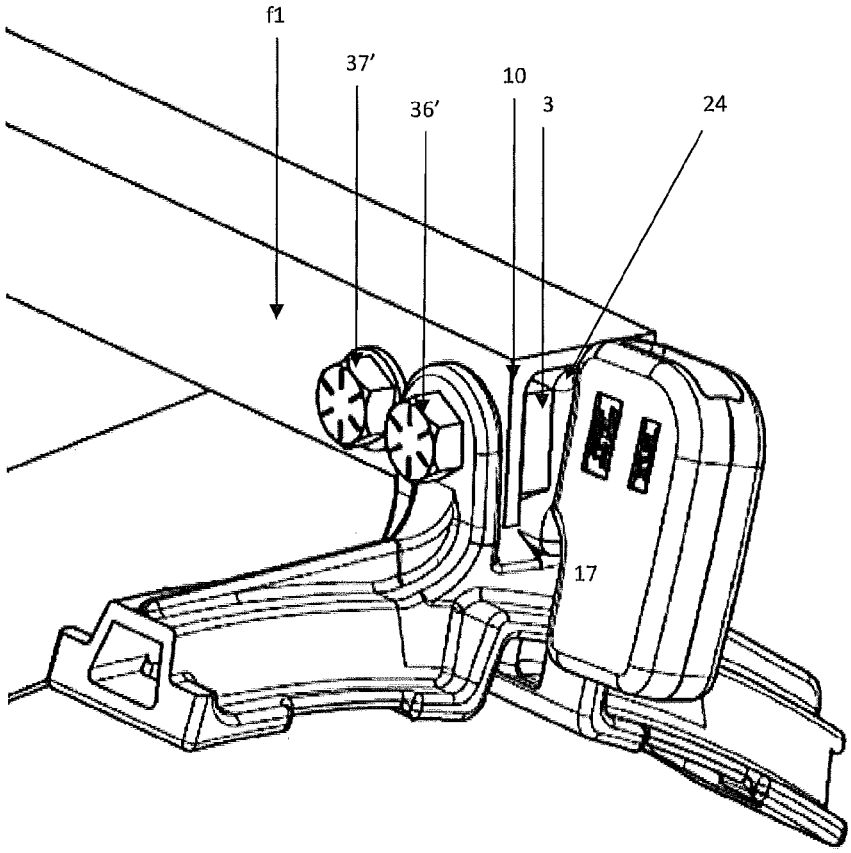
FIG. 11 is a perspective view of an end of the brake beam assembly of the first presently preferred embodiment of the brake beam assembly.

As shown more clearly in FIGS. 6-7, the compression member 6 has an L-shaped cross-section defined by a first plate 7 and a second plate 8 that are attached together, either integrally or by welding or another attachment mechanism, along their edges and having an approximately 90-degree angle between them. For instance, the compression member 6 may be extruded from a metal structure or may be otherwise molded to form such a structure. Preferably, the compression member 6 is composed of steel, but may be made of other materials having similar mechanical properties. The first plate 7 of the compression member 6 includes a first surface f1 and a second surface f2 opposite the first surface f1. The second plate 8 of the compression member 6 includes a first surface s1 and a second surface s2 opposite the first surface s1. In a preferred form, the dimension of the L-shaped cross-section is 2.5"×2.5", with each plate 7 and 8 having a thickness of 0.25". However, other dimensions of the L-shaped cross-section may be implemented without departing from the spirit and scope of the present invention.

The first plate 7 has a first end portion 9 and a second end portion 10 opposite the first end portion 9. Similarly, the second plate 8 has a first end portion 9' and a second end portion 10' opposite the first end portion 9'. The first ends 9 and 9' are adjacent to each other, and the second ends 10 and 10' are also adjacent to each other.

The first end portion 9 of the first plate 7 has a first hole 11 and a second hole 12 formed therein. The holes 11, 12 may be contiguous with the first end portion 9. Similarly, the second end portion 10 of the first plate 7 also includes a first hole 11' and a second hole 12'. The holes 11', 12' may be contiguous with the second end portion 10'. An aperture 13 is formed in the first plate 7 and is preferably positioned in the center of the first plate 7, or a central portion of the first plate 7, and is contiguous with the first plate 7.

Preferably, the compression member 6 is nearly straight or slightly bent adjacent to the aperture 13 so that the first plate 7 and second plate 8 are slightly angled. In one exemplary form, this angle can be between 0.0 and 3.5 degrees against the horizontal, or 0.0 and 7.0 degrees between each other. In a preferred form, this angle is approximately 2.87 degrees against the horizontal, that is, 5.74 degrees between each other. This higher angle provides a stronger deflection resistance to work together with the tension member cross-section of preference to reduce the brake rigging excessive elasticity while having a reduced overall brake beam width. This combination allows for a rigid brake beam at a low profile width, thus providing for added space within the truck layout for easy of brake shoe clearance for their replacement. The above angles are provided for exemplary purposes only, and other angles may be used without departing from the spirit and scope of the present invention.

In addition to the compression member 6 having a preferred L-shaped cross-section, it also has a position of preference, where the horizontal section of the "L" is in the upper side of the brake beam, so that the vertical side of the "L" section is projected downward relative to its horizontal side. This preferred position allows for a newly maximized clearance in the above portion of the brake beam central section, thus allowing for a must needed clearance for the rigging lever, rod through and rod through slack adjuster, where previously it has been typical to find a rubbing condition of these elements against the brake beam compression member, causing such elements wear out in service, and thus causing preliminary tear and wear of the elements involved and a potential buckling of its brake rigging mechanism. Additionally, this preferred disposition of the compression member 6 allows for a standard shape element with no added bends nor cuts, this increasing resistance while lowering manufacturing costs, as well as minimizing the brake beam structure twist effect during braking applications. For instance, end portions 9 and 9' of the first and second plates 7 and 8 may be aligned so that they are slightly lower or slightly higher than the central portion of the compression member 6 as a result of the bend adjacent to the aperture 13. As another example, end portions 10 and 10' of the first and second plates 7 and 8 may be aligned so that they are slightly lower or slightly higher than the central portion of the compression member 6 as a result of the bend adjacent to the aperture 13.

Figure 2:
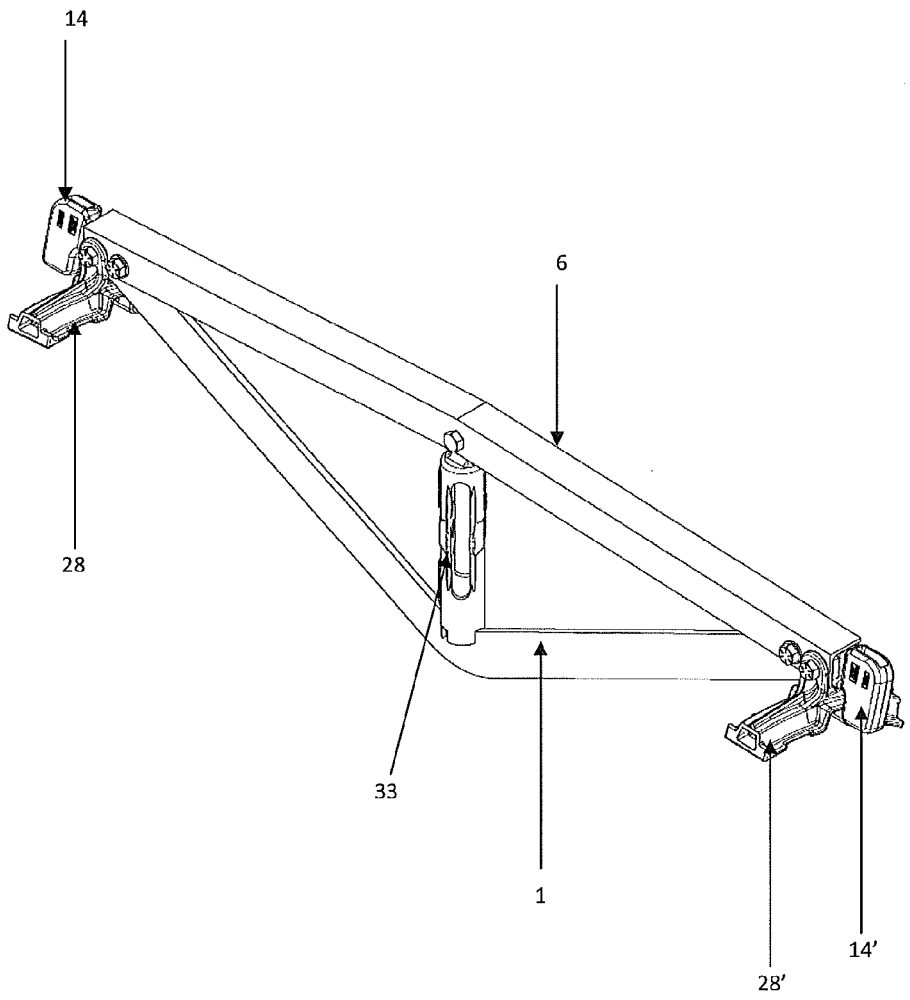
FIG. 2 is a perspective view of the first presently preferred embodiment of the brake beam assembly.
Figure 3:
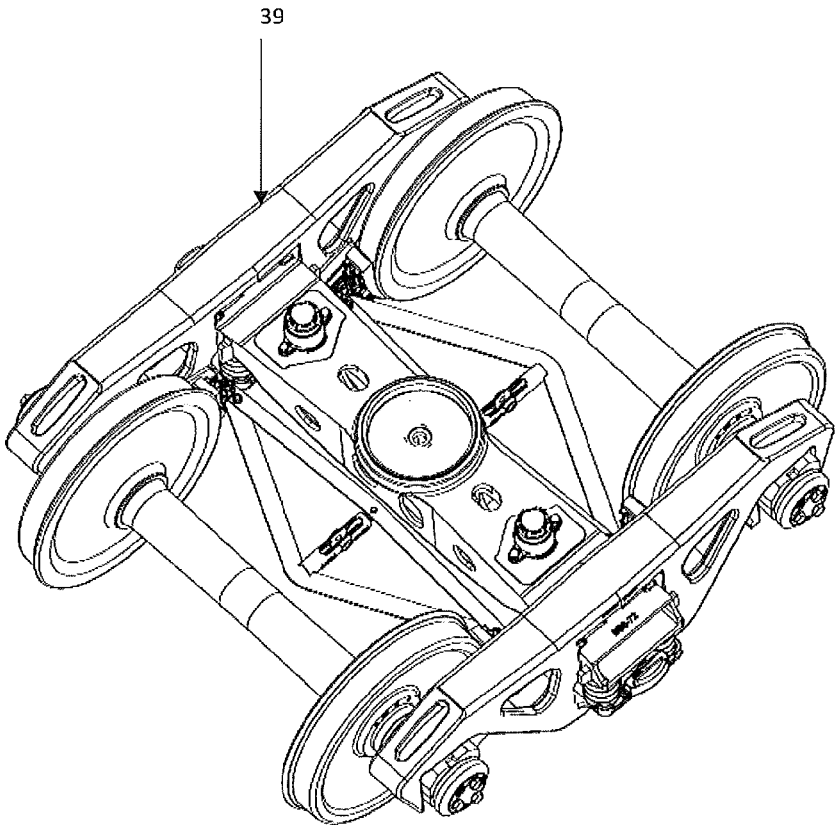
FIG. 3 is a perspective view of the first presently preferred embodiment of the brake beam assembly mounted in the truck of a railway car.
Figure 12:
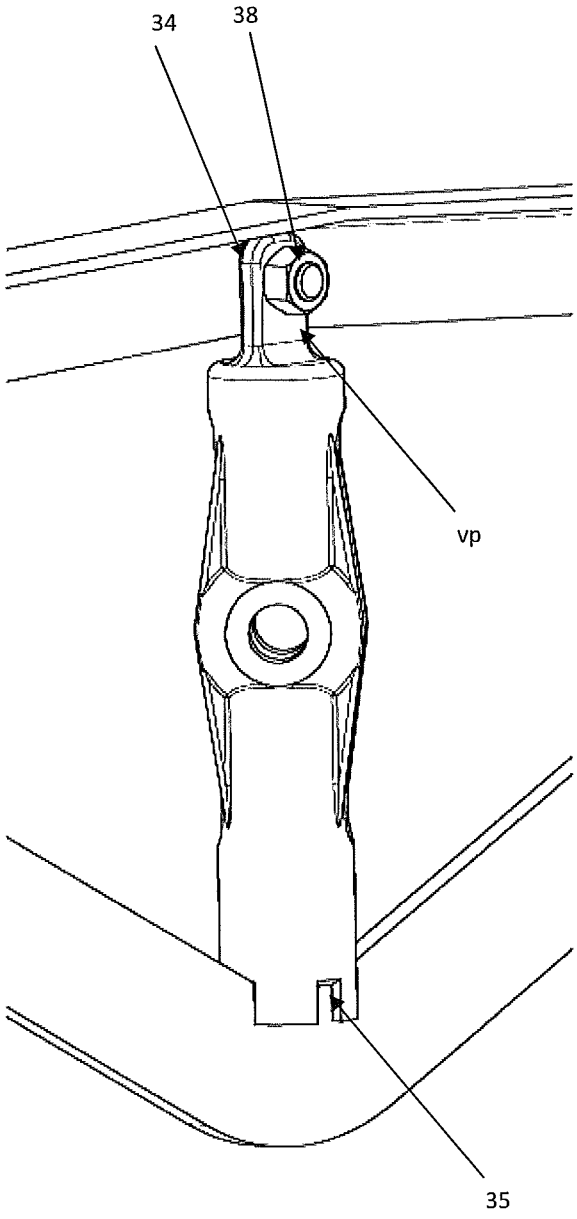
FIG. 12 is a rear view of the first presently preferred embodiment of the brake beam assembly, which focuses on the strut, or fulcrum, thereof.
Figure 13:
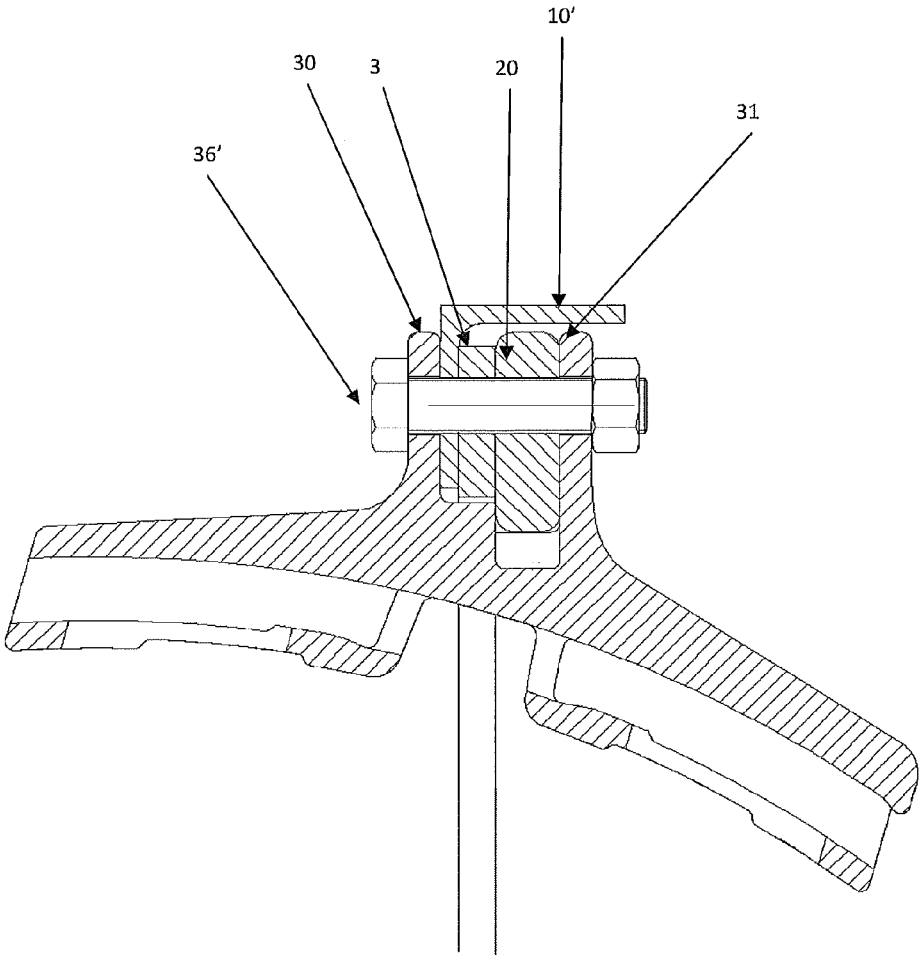
FIG. 13 is a cross sectional view of the brake head of the first presently preferred embodiment of the brake beam assembly illustrating the connection between the brake head, compression member, tension member and end extension by means of bolts.
Figure 14:
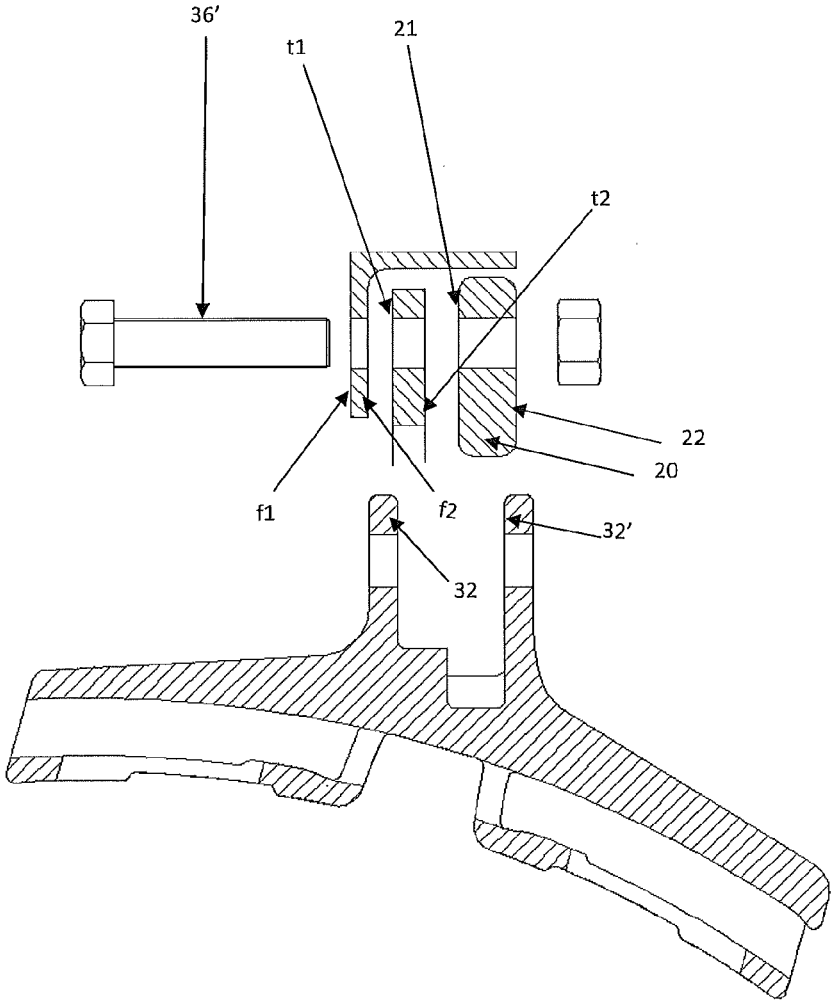
FIG. 14 is an exploded view of FIG. 13 illustrating the assembly of parts.

As shown more clearly in FIGS. 1-2 and 12, a strut or fulcrum 33 is positioned between the tension member 1 and the compression member 6. Preferably, the strut 33 extends from the apex of the V-shaped tension member 1 to a central portion of the compression member 6. The strut 33 is joined to the first surface f1 of the first plate 7 of the compression member 6 at a central portion thereof by a bolt 38 passing through a hole 34 located at the central projection vp of the strut 33 and through the hole 13 located at the central portion of the compression member 6. The strut 33 also has a tension member joining section 35 for attaching the strut to the tension member 1. The tension member joining section 35 includes a groove that is sized to receive a portion of the tension member 1 so that there is an interference attachment between the walls of the grove and the cross section of the tension member 1.

Brake heads 28, 28' are attached at opposite ends of the compression member 6 and tension member 1. The brake heads 28, 28' are preferably composed of steel, or ductile iron with similar mechanical properties, or other materials with similar mechanical properties sufficient for braking a railway car. A first brake head 28 and a second brake head 28' are positioned at opposite ends of the tension member 1 and compression member 6. As shown more clearly in FIG. 10, each brake head 28, 28' includes a retaining member 29 that defines a cavity between a first sidewall 30 and a second sidewall 31. The sidewalls 30, 31 define the generally U-shaped cavity. The first sidewall 30 includes an inner surface 32 and the second sidewall 31 includes an inner surface 32' that also help define the U-cavity. The first sidewall 30 has a hole, or perforation, p formed therein and, similarly, the second sidewall 31 has a hole, or perforation, p' formed therein. The holes p and p' are aligned to define an aperture sized and configured to receive a fastener such as, for example, a bolt.

As shown more clearly in FIGS. 1-2 and 8-9, end extensions 14 and 14' are attached to respective brake heads 28, 28'. The end extensions 28, 28' are preferably composed of steel, or ductile iron or other materials having similar mechanical properties as those of steel. Each end extension 14, 14' includes a pocket guide coupling section 15 and a brake head coupling section 16. The pocket guide coupling section 15 and the brake head coupling section 16 may be portions of a unitary structure, such as an end extension member that defines the structure or geometry of the end extension.

The pocket guide coupling section 15 has a first smooth surface 17 and a second smooth surface 18 opposite the first smooth surface 17. Preferably, the first smooth surface 17 and second smooth surface 18 are even surfaces. In one form, the pocket guide coupling section 15 may include a solid quadrangular member having the first 17 and second 18 opposed smooth surfaces. A portion of each end extension may also include a polygonal shaped opening or cavity 19. For example, the opening/cavity 19 may have a rectangular shape. As an alternative, the opening/cavity 19 could be circular or elliptical. In a preferred form, the opening/cavity 19 has a quadrangular shape leading to a superior portion of the pocket guide coupling section 15 to reduce the mass of the end extension 14, 14' and save weight. In a further preferred embodiment, the opening/cavity 19 is located on the back of the end extension 14, 14' in order to prevent water accumulation as well as to provide a solid front end where wear usually is generated after years of service and results at certain end extension models with cavities on or near the front, in another typical brake beam condemning condition. In one form, the end extensions 14, 14' include a nearly flat outside face 18' on the pocket guide coupling section 15. A nearly flat outside face 18' of the end extensions 14, 14' parallel to the side frame of the railway car minimizes grooving on the newer plastic and/or polymer based brake beam wear liners currently being implemented, by offering a flat and wider area of contact. This is an improvement to current end extensions having either a hollow face that digs into the liner or an angled face that reduces the area of contact.

The brake head coupling section 16 of each end extension 14, 14' may include a member that has a first section 20 and a second section 24. The member of the coupling section 16 may extend from the pocket guide coupling section 15 for attachment within the cavity formed in the brake heads 28, 28' to a position located beyond the brake head along a portion of the compression member 6 and/or tension member 1. The first section 20 of the member includes a first surface 21 and a second surface 22. An aperture, or opening, 23 is positioned in the first section 20 as well. The second section 24 of the member includes a first surface 25 and a second surface 26, and also includes and aperture, or opening, 27 formed therein. The openings 23 and 27 are sized and configured to align with the openings 11, 12 and 11', 12' formed in the compression member 6 and openings 4, 5 and 4', 5' formed in the tension member 1. The opening 27 is also sized and configured to align with openings p and p' formed in the brake heads 28, 28'.

As shown more clearly in FIGS. 1-2 and 8-14, each brake head 28, 28' retains a portion of the compression member 6, a portion of the tension member 1 and a portion of a respective end extension 14, 14' within the cavity of the brake head 28, 28'. For instance, an end of the tension member 1, an end of the compression member 6, and a portion of the end extension 14 are positioned in the cavity of the first brake head 28 so that hole 4 of the tension member 1, hole 11 of the compression member 6, and hole 27 of the end extension 14 are aligned with openings p and p' in the first brake head 28, such that a bolt 36 or other fastener may extend through the end extension 14, tension member 1, compression member 6, and walls 30, 31 of the first brake head 28 to attach the components together. The alignment of the end extension 14, tension member 1, and compression member 6 also permit hole 5 of the tension member 1, hole 12 of the compression member 6, and hole 23 of the end extension 14 to be aligned for receiving a second bolt 37 or other fastener that is external to the brake head cavity. The second bolt 37 attaches the compression member 6, tension member 1 and end extension 14 together and it outside of the cavity of the first brake head 28. Preferably, bolt 36 is the only fastener within the cavity of the first brake head 28.

Similarly, an end of the tension member 1, an end of the compression member 6, and a portion of the end extension 14' are positioned in the cavity of the second brake head 28' so that hole 4' of the tension member 1, hole 11' of the compression member 6, and hole 27 of the end extension 14' are aligned with openings p and p' in the second brake head 28', such that a bolt 36' or other fastener may extend through the end extension 14', tension member 1, compression member 6, and walls 31, 31 of the second brake head 28' to attach the components together. The alignment of the end extension 14', tension member 1, and compression member 6 also permit hole 5' of the tension member 1, hole 12' of the compression member 6, and hole 23 of the end extension 14' to be aligned for receiving a second bolt 37' or other fastener that is external to the brake head cavity. The second bolt 37' attaches the compression member 6, tension member 1 and end extension 14' together and it outside of the cavity of the second brake head 28'. Preferably, bolt 36' is the only fastener within the cavity of the second brake head 28'.

Each brake head 28, 28' is attached to a respective end extension 14, 14' and respective ends of the tension member 1 and compression member 6, such that each end portion of the first plate 7 of the compression member 6 is within the cavity defined by U-shaped retaining member 29 of the brake heads 28, 28' so that the first surface f1 of each end portion of the first plate 7 contacts the inner surface 32 of the first sidewall 30 of the brake heads 28, 28'. Each hole 11, 11' of the respective end portions of the compression member 6 is aligned with openings p and p' of the first and second sidewalls 30 and 31, respectively. Each end portion of the tension member 1 is also within the cavity defined by the U-shaped retaining member 29 of the brake heads 28, 28', so that the first surface t1 of tension member 1 end portion contacts the second surface f2 of the first plate 7 of the compression member 6, and each first hole 4, 4' of the tension member 1 is aligned with the openings p, p' in the brake heads 28, 28'. Additionally, the brake head coupling section 16 of each end extension 14, 14' is within the cavity defined by the U-shaped retaining member 29 of the brake heads 28, 28' such that a portion of the end extension 14, 14' is retained between the second surface t2 of the tension member 1 and the inner surface 32' of the second sidewall 31 of the U-shaped retaining member 29. The tension member 1, compression member 6 and end extension 14, 14' are aligned such that the openings p and p' in the respective brake head 28, 28' align with openings 4, 4' of the tension member 1, openings 11, '11 of the compression member 6, and opening 27 of the end extensions 14, 14' so that a bolt 36, 36' may pass through these openings to attach the end extension 14, 14', compression member 6, tension member 1, and brake head 28, 28' together. Connection configurations of the placement of elements within the brake head cavity other than the one described above may be implemented without departing from the spirit and scope of the present invention.

The end extensions 14, 14' are also be attached to respective ends of the compression member 6 and tension member 1 by a second bolt 37, 37' that is external to the brake head cavity. The second bolt 37, 37' passes through the second hole 5, 5' of the tension member 1, the second hole 12, 12' of the compression member 6, and the hole 23 formed in the coupling section 16 of the respective end extension 14, 14'. The bolt 37, 37' may also have end portions that are uncovered and adjacent to the brake head 28, 28' so that the bolt 37, 37' is visible even when brake heads 28, 28' are attached to the brake beam assembly. The exposed head and ends of the bolt 37, 37' permit a user to tighten or loosen the bolt 37, 37' without having to remove the adjacent brake head 28, 28'.

When an embodiment of the brake beam assembly is installed in a truck of a railway car 39 (see FIG. 3), the second plate 8 of the compression member generally faces downward, which can leave space for levers and slack adjusters (not shown), which may avoid possible damage to the elements and to the brake beam assembly caused by friction between these elements.

Since the brake heads 28 and 28' are independent and separate elements from the end extensions 14 and 14', and from the compression member 6 and tension member 1, it is possible to replace any brake head 28, 28' without dismounting or disassembling the compression member 6 or tension member 1 from the railway car. For example, only one bolt 36, 36' or other fastener need be removed from the brake head 28, 28' openings p and p' to remove a brake head 28, 28' from the other components of the brake beam assembly in order to replace the brake head 28, 28'. No cutting of the tension member 1 or compression member 6 is needed. For instance, the second bolt 37, 37' keeps the other components (tension member 1, compression member 6 and end extensions 14, 14') attached together such that the brake head 28, 28' may be replaced without requiring any disassembly of the other components.

Nor does the entire beam assembly have to be dismounted or removed from the railway car. For instance, one brake head 28 may be removed and replaced and, after the first brake head 28 is replaced, the second brake head 28' may be removed and replaced. Such repair may permit the brake beam assembly to be fixed or maintained without removal of the entire brake beam assembly or the time consuming cutting and reattaching of the tension member 1 and compression member 6. As another example, both brake heads 28, 28' may be replaced at the same time since the end extensions 14, 14' are still attached to respective ends of the tension member 1 and compression member 6 via bolts 37, 37'.

The independent brake heads 28 and 28' may also permit a cost savings in piece modelling or piece manufacturing since the brake heads are more easily cast and less costly because they do not include an end extension being integrally molded onto the brake head as disclosed, for example, in U.S. Pat. Nos. 5,810,124, 6,155,388, and 6,155,389. Since brake heads are often replaced due to wear much more frequently than any other component of a brake beam assembly, this cost savings may be significant and can permit replacement of brake heads to be done at a lower cost than other brake beam assembly designs and at a much faster rate.

Preferably, the strut 33 is a one piece element and is retained on the tension member 1 via a groove (not shown) for retaining a portion of the tension member 1 without the need of additional components, and is retained on the compression member 6 by means of a vertical projection vp so that the tension is supported by the fulcrum only and not by any other weaker elements. It should be appreciated that the strut 33 may be a reversible fulcrum, or a fulcrum that is not reversible, or a semi-reversible fulcrum.

Preferably, the compression member 6 is relatively lightweight and needs very few steps for its manufacture. For instance, preferably, a metal structure may be bent slightly and subsequently have five openings punched therein via a punching mechanism for forming the compression member 6.

The brake heads 28, 28', tension member 1, compression member 6, and end extensions 14, 14' are preferably sufficiently thick to accept bolts having a grip length of between 1.5 inches to 3.5 inches, and preferably a grip length at the two inner bolts 37, 37' of 1.625 inches and a grip length of 2.5 inches at the two outer bolts 36, 36' joining the brake heads 28, 28' to the brake beam, at both beam ends, for extending the operational life of these components attached within the cavity of the brake head 28, 28'. Such a relatively large bolt can permit a better grip and interference arrangement of the components attached together, with an elastic deformation during assembly large enough to compensate for the wear due to aging and fatigue for the brake beam life in service.

While certain presently preferred embodiments of the brake beam assembly and certain embodiments of methods of practicing the same have been shown and described herein with particular reference to the drawings, it is to be distinctly understood that the invention is not limited thereto but may be otherwise variously embodied and practiced within the scope of the following claims. It should be understood that various modifications could be made without departing from the spirit and scope of the present invention. Those skilled in the art will appreciate that various other modifications and alterations could be developed in light of the overall teachings of the disclosure. The presently preferred embodiments described herein are meant to be illustrative only and not limiting as to the scope of the invention, which is to be given the full breadth of the appended claims and any and all equivalents thereof.

What is claimed is:

1. A brake beam assembly comprising:

a generally V-shaped tension member having a first end portion and a second end portion opposite the first end portion and an apex portion located adjacent a front side of the brake beam assembly between the first end portion and the second end portion, the first end portion of the generally V-shaped tension member having a first aperture and a second aperture, and the second end portion of the generally V-shaped tension member having a first aperture and a second aperture;

a compression member located adjacent a rear side of the brake beam assembly and having a first end portion and a second end portion opposite the first end portion and a central portion positioned between the first end portion and the second end portion, the first end portion of the compression member having a first aperture and a second aperture, and the second end portion of the compression member having a first aperture and a second aperture;

a strut member positioned between the generally V-shaped tension member and the compression member, the strut member having a first end portion and a second end portion opposite the first end portion, the first end portion of the strut member attached to the apex portion of the generally V-shaped tension member, the second end portion of the strut member attached to the central portion of the compression member;

a first end extension having a pocket guide coupling portion and a brake head coupling portion integrally formed, the brake head coupling portion having a first opening and a second opening, the pocket guide coupling portion sized and configured for attachment to a portion of a railway car, the pocket guide coupling portion of the first end extension defining a rear cavity therein to prevent water accumulation and further defining a solid front end, the rear cavity having an opening facing in a rearward direction of the brake beam assembly from the rear side thereof, the rear cavity being further from the apex portion of the generally V-shaped tension member than the solid front end, the solid front end facing in a frontward direction of the brake beam assembly toward the front side thereof;

a second end extension having a pocket guide coupling portion and a brake head coupling portion integrally formed, the brake head coupling portion having a first opening and a second opening, the pocket guide coupling portion sized and configured for attachment to a portion of a railway car, the pocket guide coupling portion of the second end extension defining a rear cavity therein to prevent water accumulation and further defining a solid front end, the rear cavity having an opening facing in a rearward direction of the brake beam assembly from the rear side thereof, the rear cavity being further from the apex portion of the generally V-shaped tension member than the solid front end, the solid front end facing in a frontward direction of the brake beam assembly toward the front side thereof;

a first brake head integrally formed of metal having sidewalls that define a cavity sized and configured to receive the first end portion of the tension member, the first end portion of the compression member and the brake head coupling portion of the first end extension, the cavity being in communication with a first hole and a second hole formed in the sidewalls of the first brake head, the first end portion of the compression member, the first end portion of the tension member and the brake head coupling portion of the first end extension positioned within the cavity of the first brake head such that the first aperture of the first end portion of the tension member, the first aperture of the first end portion of the compression member, the first opening of the brake head coupling portion of the first end extension and the first and second holes of the first brake head are aligned to receive a first fastener, the first fastener being a lone fastener attaching the first end portion of the compression member, the first end portion of the tension member and the brake head coupling portion of the first end extension to the first brake head when the first fastener extends through the first aperture of the first end portion of the tension member, the first aperture of the first end portion of the compression member, the first opening of the brake head coupling portion of the first end extension and the first and second holes of the first brake head; and a second brake head integrally formed of metal having sidewalls that a cavity sized and configured to receive the second end portion of the tension member, the second end portion of the compression member and the brake head coupling portion of the second end extension, the cavity being in communication with a first hole and a second hole formed in the sidewalls of the second brake head, the second end portion of the compression member, the second end portion of the tension member and the brake head coupling portion of the second end extension positioned within the cavity of the second brake head such that the first aperture of the second end portion of the tension member, the first aperture of the second end portion of the compression member, the first opening of the brake head coupling portion of the second end extension and the first and second holes of the second brake head are aligned to receive a second fastener, the second fastener being a lone fastener attaching the second end portion of the compression member, the second end portion of the tension member and the brake head coupling portion of the second end extension to the second brake head when the second fastener extends through the first aperture of the second end portion of the tension member, the first aperture of the second end portion of the compression member, the first opening of the brake head coupling portion of the second end extension and the first and second holes of the second brake head, wherein the first end extension, the first end portion of the tension member and the first end portion of the compression member are aligned such that the second opening of the brake head coupling portion of the first end extension, the second aperture of the first end portion of the tension member and the second aperture of the first end portion of the compression member are aligned to receive a third fastener attaching the first end extension, the first end portion of the tension member and the first end portion of the compression member together at a position external to the first brake head cavity and positioned closer to the central portion of the compression member than the first brake head, wherein the second end extension, the second end portion of the tension member and the second end portion of the compression member are aligned such that the second opening of the brake head coupling portion of the second end extension, the second aperture of the second end portion of the tension member and the second aperture of the second end portion of the compression member are aligned to receive a fourth fastener attaching the second end extension, the second end portion of the tension member and the second end portion of the compression member together at a position external to the second brake head cavity and positioned closer to the central portion of the compression member than the second brake head, wherein the first end extension and first brake head are independent structures, wherein the second end extension and the second brake head are independent structures, wherein the first brake head is removable by removal of the first fastener with the tension member, compression member and first end extension remaining attached via the third fastener such that the first brake head is removable from the brake beam assembly without disassembly of any of the first end extension, compression member and tension member that are attached together via the third fastener and the fourth fastener, and wherein the second brake head is removable by removal of the second fastener with the tension member, compression member and second end extension remaining attached via the fourth fastener such that the second brake head is removable from the brake beam assembly without disassembly of any of the second end extension, compression member and tension member that are attached together via the third fastener and the fourth fastener.

2. The brake beam assembly of claim 1, wherein each of the first, second, third and fourth fasteners are bolts and wherein the first brake head is removable without requiring disassembly of the second brake head and without requiring disassembly of the brake beam assembly from a rail car.

3. The brake beam assembly of claim 1, wherein the compression member includes an L-shaped cross-section and comprises a first plate attached to a second plate along respective edges thereof such that the first plate defines a surface that is positioned approximately 90-degrees relative to a surface defined by the second plate.

4. The brake beam assembly of claim 1, wherein the first fastener is the only fastener positioned in the cavity of the first brake head, and wherein the second fastener is the only fastener positioned in the cavity of the second brake head.

5. The brake beam assembly of claim 1, wherein the compression member, the generally V-shaped tension member, the first end extension and the second end extension are comprised of steel or ductile iron, and wherein the strut member is either a reversible fulcrum or a non-reversible fulcrum.

6. The brake beam assembly of claim 1, wherein the cavity of the first brake head is at least partially defined by a first generally U-shaped retaining member, and wherein the cavity of the second brake head is at least partially defined by a second generally U-shaped retaining member.

7. The brake beam assembly of claim 1, wherein the compression member is divided by its centre in a first and a second symmetrical portion in which the first and second symmetrical portions are not coplanar to each other but bent at a slight angle of 0.0 to 7.0 degrees between each other.

8. The brake beam assembly of claim 1, wherein the tension member is flat and has a generally rectangular cross-section.

9. The brake beam assembly of claim 3, wherein the brake beam assembly is installed on a railway car such that a horizontal section of the "L" cross-section is disposed on an upper side of the brake beam assembly, and a vertical side of the "L" cross-section is projected downward relative to the horizontal section.

10. The brake beam assembly of claim 3, wherein the L-shaped cross-section has a dimension of 2.5"×2.5", with each of the first and second plates having a thickness of 0.25".

11. A brake beam assembly comprising:

a compression member having first and second end portions, the compression member located adjacent a rear side of the brake beam assembly;

a tension member having first and second end portions, the tension member located adjacent a front side of the brake beam assembly;

a strut member attached between the tension member and the compression member;

a first end extension having first and second portions integrally formed, the first portion of the first end extension defining a rear cavity therein to prevent water accumulation and further defining a solid front end, the rear cavity having an opening facing in a rearward direction of the brake beam assembly from the rear side thereof, the solid front end facing in a frontward direction of the brake beam assembly toward the front side of the brake beam assembly that is opposite the rear side of the brake beam assembly, the first end portions of the compression member and the tension member being adjacent to the rear cavity;

a first brake head having a generally U-shaped retaining member; and first and second fasteners, wherein the generally U-shaped retaining member of the first brake head receives the first end portion of the tension member, the first end portion of the compression member and the first portion of the first end extension such that the first fastener extends through apertures formed in the generally U-shaped retaining member, compression member, tension member and first end extension to attach the first brake head, tension member, compression member and first end extension together, the first fastener being a lone fastener attaching the first end portion of the tension member, the first end portion of the compression member, the first portion of the first end extension and the first brake head together, wherein the second portion of the first end extension extends beyond the generally U-shaped retaining member and is positioned external to the generally U-shaped retaining member of the first brake head such that the second portion of the first end extension is closer to the strut than the generally U-shaped retaining member of the first brake head, wherein the second fastener extends through apertures formed in the second portion of the first end extension, the compression member and the tension member to attach the tension member, compression member and first end extension together at a position located external to the generally U-shaped retaining member of the first brake head, and wherein the first brake head is removable by removal of the first fastener with the tension member, compression member and first end extension remaining attached via the second fastener such that the first brake head is removable from the brake beam assembly without disassembly of any of the first end extension, compression member and tension member that are attached together via the second fastener.

12. The brake beam assembly of claim 11, further comprising:

a second end extension having first and second portions integrally formed, the first portion of the second end extension defining a rear cavity therein to prevent water accumulation and further defining a solid front end, the rear cavity having an opening facing in a rearward direction of the brake beam assembly from the rear side thereof, the solid front end facing in a frontward direction of the brake beam assembly toward the front side of the brake beam assembly that is opposite the rear side of the brake beam assembly, the second end portions of the compression member and the tension member being adjacent to the rear cavity; and a second brake head having a generally U-shaped retaining member; and third and fourth fasteners, wherein the generally U-shaped retaining member of the second brake head receives the second end portion of the tension member, the second end portion of the compression member and the first portion of the second end extension such that the third fastener extends through apertures formed in the generally U-shaped retaining member, compression member, tension member and first end of the second end extension to attach the second brake head, tension member, compression member and second end extension together, wherein the second portion of the second end extension extends beyond the generally U-shaped retaining member and is positioned external to the generally U-shaped retaining member of the second brake head such that the second portion of the second end extension is closer to the strut than the generally U-shaped retaining member of the second brake head, wherein the fourth fastener extends through apertures formed in the second portion of the second end extension, the compression member and the tension member to attach the tension member, compression member and second end extension together at a position located external to the generally U-shaped retaining member of the second brake head, and wherein the second brake head is removable by removal of the third fastener with the tension member, compression member and second end extension remaining attached via at least one of the second fastener and the fourth fastener.

13. The brake beam assembly of claim 12, wherein the first, second, third and fourth fasteners comprise bolts.

14. The brake beam assembly of claim 11, wherein the tension member comprises a V-shaped tension member, and wherein the compression member has an L-shaped cross-section.

15. The brake beam assembly of claim 11, wherein the compression member is divided by its centre in a first and a second symmetrical portion in which the first and second symmetrical portions are not coplanar to each other but bent at a slight angle of 0.0 to 7.0 degrees between each other.

16. A brake beam assembly comprising:

a V-shaped tension member having a first and a second end portion, said V-shaped tension member having a flat shaped cross-section and a first and a second surface, an apex of the V-shaped tension member being adjacent a front side of the brake beam assembly;

a compression member located adjacent a rear side of the brake beam assembly and having an L-shaped cross-section and including a first plate and a second plate which extend the entire length of the compression member and having an approximately 90-degree angle between them, wherein the first and second plates each having a first and a second end portion;

two end extensions, each having a pocket guide coupling section and a brake head coupling section integrally formed, the pocket guide coupling section having a solid front end portion and a rear cavity defined therein to prevent water accumulation, the rear cavity having an opening facing in a rearward direction of the brake beam assembly away from the rear side of the brake beam assembly, the solid front end facing in a frontward direction of the brake beam assembly toward the front side thereof that is opposite the rearward direction;

two brake heads, each of the brake heads having a retaining member for tightly receiving an end of the tension member, an end of the first plate of the compression member, and the brake head coupling section of an end extension;

a fulcrum joined to the tension member and compression member, so that the fulcrum remains between the tension and compression members;

wherein:

each end portion of the tension member is retained and joined to a respective retaining member of a respective brake head, each end portion of the first plate of the tension member is retained and joined to a respective retaining member of a respective brake head, the brake head coupling section of each end extension is retained and joined to a respective retaining member of a respective brake head, each end portion of the tension member, each end portion of the first plate of the tension member, and the brake head coupling section of each end extension are joined together at the respective brake head retaining member by means of a respective first bolt passing through coinciding perforations located at: each end portion of the tension member, at each end portion of the first plate of the compression member, at the second section of the brake head coupling section of each end extension, and through at least one coinciding perforation located at each brake head retaining member, the first bolt being a lone fastener attaching the end portion of the tension member, end portion of the first plate of the tension member, and the brake head coupling section of the end extension and brake head retaining member, each end of the tension and compression members, and a corresponding end extension are further joined together at a position remote from the brake head retaining member by a second bolt passing through coinciding perforations located at: each end portion of the tension member, at each end portion of the first plate of the compression member, and at the first section of the brake head coupling section of each end extension, and each brake head is removable by removal of the first bolt passing through the brake head retaining member with the tension member, compression member and end extensions remaining attached via the second bolt located at the position remote from the brake head retaining member such that each brake head is removable from the brake beam assembly without disassembly of any of the end extensions, the compression member and the tension member.

17. The brake beam assembly of claim 16, wherein the compression member is divided by its centre in a first and a second symmetrical portion in which the plate sections of both portions are not coplanar to each other but bent at a slight angle of 0.0 to 7.0 degrees between each other.

18. The brake beam assembly of claim 16, wherein the rear cavity of the pocket guide coupling section of each end extension is a quadrangular cavity and wherein the pocket guide coupling section comprises a solid quadrangular member having a first smooth surface, a second smooth surface, wherein the quadrangular cavity leading to a superior portion of the pocket guide coupling section to reduce the mass of the end extension and save weight in addition to preventing water accumulation.

19. The brake beam assembly of claim 16, wherein each brake head coupling section comprises:

a first section comprising a round section having a first and a second surface and including a perforation in a central portion thereof, and a second section comprising an irregular shaped section having a first and a second surface which are coplanar with the first and second surfaces of the round section and including a perforation in a central portion thereof.

20. The brake head assembly of claim 16, wherein each brake head retaining member comprises a U-shaped retaining member formed by first and second opposite walls depending from the brake head, each including a perforation in a central portion thereof and an inner surface.

21. The brake head assembly of claim 16, wherein the fulcrum comprises a reversible fulcrum, a non-reversible fulcrum, or a semi-reversible fulcrum.

22. The brake head assembly of claim 16, wherein:

each brake head retaining member comprises a U-shaped retaining member formed by first and second opposite walls depending from the brake head, each including a perforation in a central portion thereof and an inner surface, the brake head coupling section having a first section including a perforation in a central portion and a second section including a perforation in a central portion thereof, each end portion of the tension member is retained in a respective U-shaped retaining member of a respective brake head in such way that its first surface at said end portion contacts the inner surface of the U-shaped retaining member and the first perforation of each pair of perforations coincides with the central perforation of the U-shaped retaining member, each end portion of the first plate of the compression member is retained in a respective U-shaped retaining member of a respective brake head in such way that its first surface at said end portion contacts the inner surface of the U-shaped retaining member and the first perforation of each pair of perforations coincides with the central perforation of the U-shaped retaining member, the brake head coupling section of each end extension is retained in a respective U-shaped retaining member of a respective brake head in such way that its first and second sections are retained between the tension and compression members such that a first surface of its first and second sections contacts the second surface of the end portion of the compression member and a second surface of its first and second sections contacts the first surface of the end portion of the tension member and the first perforations of the tension and compression members, the perforation of the second section of the end extension and the perforations of both opposite walls of the U-shaped retaining member coincide, and wherein the second perforations at both end portions of the tension and compression members and the corresponding perforations located at the first section of each end extension coincide.

23. The brake beam assembly of claim 16, wherein:

the fulcrum includes a compression member joining projection including a central perforation thereof and a tension member joining section located at an inferior end of the fulcrum including a groove for receiving the flat cross-section of the tension member, and the fulcrum is joined to the first surface of the first plate at a central portion thereof by means of a bolt passing through the perforation located at the compression member joining member and through a perforation located at a central portion of the first plate of the compression member, and wherein the tension member joining section joins to the tension member only by interference between the walls of the groove and the cross-section of the tension member.

24. The brake beam assembly of claim 16, wherein the rear cavity of the pocket guide coupling section is shaped as a rectangular cavity.

25. The brake beam assembly of claim 13, wherein the second portions of the two end extensions each include a nearly flat outside face which runs parallel to a side frame of a railway car when the brake beam assembly is attached to the railway car.

* * * * *